United States Patent [19]

Hidaka

[11] Patent Number: 5,028,919

[45] Date of Patent: Jul. 2, 1991

[54] LEARNING REMOTE CONTROL DEVICE

[75] Inventor: Hidenori Hidaka, Tokyo, Japan

[73] Assignee: Pioneer Electronic Corporation, Tokyo, Japan

[21] Appl. No.: 511,887

[22] Filed: Apr. 20, 1990

Related U.S. Application Data

[63] Continuation of Ser. No. 197,244, May 23, 1988, abandoned.

[30] Foreign Application Priority Data

May 22, 1987 [JP] Japan ..... 62-123935

[51] Int. Cl.[5] ..... H04B 10/00

[52] U.S. Cl. ..... 340/825.72; 340/825.69; 341/176; 358/194.1

[58] Field of Search ..... 340/825.72, 825.69, 340/825.56, 711, 825.71; 358/194.1; 341/176

[56] References Cited

U.S. PATENT DOCUMENTS

| | | | |
|---|---|---|---|
| 4,626,848 | 12/1986 | Ehlers | 340/825.72 |
| 4,712,105 | 12/1987 | Kohler | 340/825.69 |
| 4,746,919 | 5/1988 | Reitmeier | 340/825.69 |
| 4,769,643 | 9/1988 | Sogama | 340/825.69 |
| 4,807,052 | 2/1989 | Amano | 340/825.72 |
| 4,825,200 | 4/1989 | Evans et al. | 340/825.56 |
| 4,825,209 | 4/1989 | Sasaki et al. | 340/825.72 |
| 4,857,898 | 8/1989 | Smith | 341/176 |
| 4,905,279 | 2/1990 | Nishio | 340/825.69 |
| 4,959,810 | 9/1990 | Darbee et al. | 340/825.69 |

*Primary Examiner*—Donald J. Yusko
*Assistant Examiner*—Yuk H. Lau
*Attorney, Agent, or Firm*—Sughrue, Mion, Zinn, Macpeak & Seas

[57] ABSTRACT

A learning remote control device includes: a receiving section for receiving and demodulating a remote control signal from a remote control device; a memory for storing data obtained by the receiving section through demodulation; control keys each corresponding to a prescribed storage region of the memory; a transmitting section for reproducing the remote control signal on the basis of the data read from the memory and for transmitting the reproduced remote control signal; a switch for shifting the operation mode of the learning remote control device to reception mode or transmission mode; and a control section for writing the data from the receiving section into the storage region corresponding to one of the control keys in case that the operation mode is shifted to the reception mode by the switch, and for reading the data from the storage region corresponding to an operated one of the control keys to send out to the transmitting section in case that the operation mode is shifted to the transmission mode by the switch.

6 Claims, 2 Drawing Sheets

LEARNING REMOTE CONTROL DEVICE

This is a continuation of application Ser. No. 07/197,244 filed May 23, 1988now abandoned.

BACKGROUND OF THE INVENTION

The present invention relates to a remote control device for remotely controlling an electric appliance or the like by using infrared rays or the like, and particularly relates to a learning remote control device in which a remote control signal from another remote control device for an electric appliance or the like is recorded so that the learning remote control device can remotely control a plurality of electric appliances by itself.

The operation mode of an appliance such as a television set, a video cassette recorder and an audio machine can be shifted by a remote control, device employing infrared rays or the like. Besides, there is a learning remote control device in which a remote control signal from a remote control device is recorded so that the learning remote control device can remotely control a plurality of appliances by itself.

FIG. 4(*a*) shows a remote control signal which is used by a non-learning remote control device, while FIG. 4(*b*) shows signal data which are stored by a conventional learning remote control device. The non-learning remote control device transmits the remote control signal which is intermittent as shown in FIG. 4(*a*. A remotely controlled appliance detects the pattern of the remote control signal to find out a preset code to perform an action corresponding to the preset code. The times $t_1$, $t_3$, . . . and $t_9$ during which the level of the remote control signal transmitted by the non-learning remote control device is nonzero, and the other times $t_2$, $t_4$, . . . and $t_{10}$ during which the level of the remote control signal is zero are measured by the timer of the learning remote control device or through software control or the like so that a combination of the data of the measured times shown in FIG. 4(*b*) is stored in a portion of a memory, which corresponds to a control key manipulated selectively beforehand or to the like. When the control key is manipulated afterwards, the combination of the data stored in the portion of the memory, which corresponds to the control key, is read from the portion of the memory and the widths of pulses transmitted on the basis of the combination of the data are regulated so that the remote control signal is reproduced and transmitted.

FIG. 3 shows a block diagram of the conventional learning remote control device comprising a receiving section 11 which receives the remote control signal transmitted from the non-learning remote control device through the use of infrared rays or the like and performs the infrared/electric conversion of the received remote control signal; a control section 12 which processes the data of the remote control signal received by the receiving section; the memory 13 for storing the data of the received remote control signal; a plurality of control keys 14, each of which is manipulated to store the data of a remote control signal or to select stored data to transmit a reproduced remote control signal; a switch 15 for shifting the operation mode of the learning remote control device to store the data of the remote control signal or transmit the reproduced remote control signal; a display section 16 for indicating the sequence of the operation of the learning remote control device, a manipulating instruction or the like to the user of the device; and a transmitting section 17 which performs the electric/infrared conversion of the stored data selected by the control key, to reproduce the remote control signal, and transmits the reproduced remote control signal.

When the remote control signal is transmitted by manipulating the non-learning remote control device, the remote control signal is received and demodulated by the receiving section 11 of the learning remote control device so that the time data of the signal are obtained. The combination of the time data of the remote control signal is written in the reception buffer of the memory 13 by the control section 12. When the writing of the combination of the time data of the remote control signal in the reception buffer is completed, the display section 16 makes an indication to urge the user to re-manipulate the same control key of the non-learning remote control device. When the same control key is re-manipulated so that the remote control signal is transmitted from the non-learning remote control device, the signal is received and demodulated by the receiving section 11 again so that the combination of the time data of the signal is obtained again and compared in the control section 12 with that previously written in the reception buffer. If the mutually compared combinations of the time data are coincident with each other, the combination is written in a storage region of the memory 13, which corresponds to the same control key 14. This process of transmitting the same remote control signal twice ensures that the remote control signal has been properly received and demodulated. The same number of remote control signals as the control key 14 can thus be recorded to remotely control the appliance by the learning remote control device.

When a desired control key 14 is manipulated as the operation mode of the learning remote control device is shifted for transmission, the data are read from the storage region of the memory 13, which corresponds to the manipulated control key, and the remote control signal corresponding to the read data is reproduced and transmitted by the transmitting section 17, so that the appliance is remotely controlled by the learning remote control device in the same manner as it is remotely controlled by the non-learning remote control device.

There are remote control signals each having a prefix furnished in consideration of the future extension of the code of the signal, the adjustment of input level of a light receiving portion or the like. The prefix is furnished at a code which is for changing the channel of a television set, the operation mode of an amplifier or a video cassette recorder or the like. Not only the prefix of the remote control signal, which acts so as to sequentially change the status of an appliance when a single key is continually manipulated, but also that of the other remote control signal, which acts so as not to sequentially change the status of the appliance when the single key is continually manipulated, are sequentially altered along with the continual manipulation of the single key. For example, cyclic remote control signals, in which prefixes a, b, c and d which differ from each other for the various operation modes of a control amplifier or the like are added in front of codes x which are for stepwise changing the use of a tuner, a player, a compact disk and an auxiliary unit in cyclic order by sequentially manipulating a single key of a remote control device, as shown in FIG. 2, are sequentially transmitted along with the sequential manipulation of the single key.

Since the prefixes of the cyclic remote control signals vary as the single key is sequentially manipulated, the data of the cyclic remote control signal transmitted by manipulating the key firstly and received by the conventional learning remote control device do not coincide with those of the other cyclic remote control signal transmitted by manipulating the key secondly and received by the conventional learning remote control device. For that reason, there is a problem that the conventional learning remote control device cannot store the data of the cyclic remote control signals.

SUMMARY OF THE INVENTION

The present invention was made in order to solve the above-mentioned problem.

Accordingly, it is an object of the present invention to provide a learning remote control device which can perform remote control on the basis of cyclic remote control signals as well as non-cyclic remote control signals. The learning remote control device comprises a receiving section which receives and demodulates a remote control signal from a remote control device; a memory which stores data obtained through the demodulation of the received remote control signal; control keys corresponding to the prescribed storage regions of the memory; a transmitting section which reproduces the remote control signal from the data read from the memory and transmits the reproduced remote control signal; a switch for shifting the operation mode of the learning remote control device for reception or transmission; and a control section which acts so that the data sent out from the receiving section are stored in the storage region corresponding to the control key, as the operation mode of the learning remote control device is shifted for the reception by the switch and that the data are read from the storage region corresponding to the control key and are sent out to the transmitting section, at the time of manipulation of the control key, as the operation mode of the learning remote control device is shifted for the transmission by the switch. For that reason, the data of the cyclic remote control signals whose prefixes differ from each other can be also stored in the storage regions of the memory to perform the remote control on the basis of the cyclic remote control signals as well as the non-cyclic remote control signals.

DETAILED DESCRIPTION OF EXEMPLARY EMBODIMENT

An embodiment of the present invention, which is a learning remote control device, is hereafter described in detail with reference to the drawings attached hereto.

Figure 1:
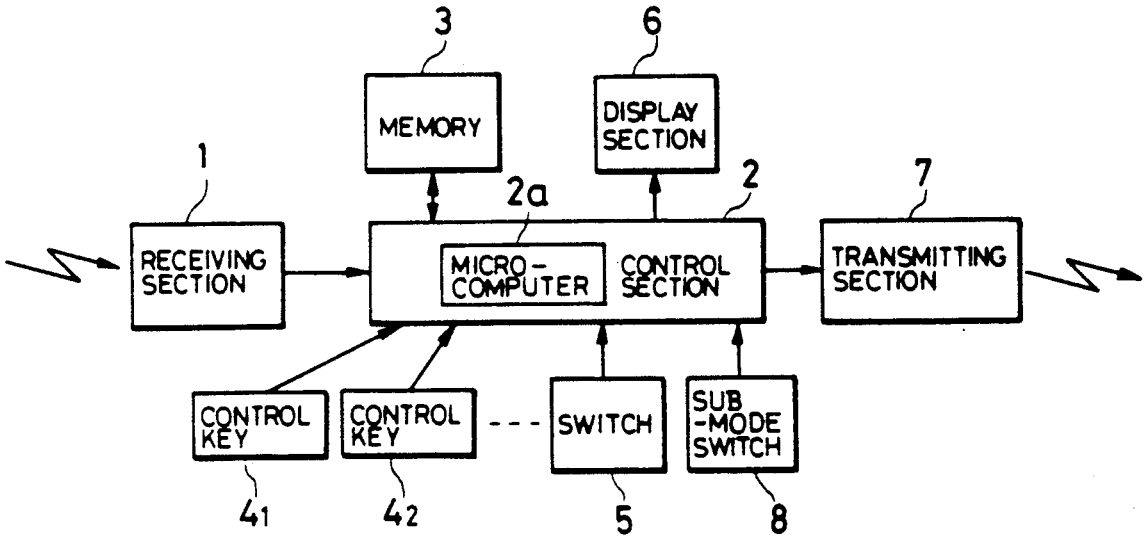
FIG. 1 shows a block diagram of a learning remote control device which is an embodiment of the present invention.

FIG. 1 shows a block diagram of the learning remote control device comprising a receiving section 1 which receives a remote control signal made of infrared rays or the like and transmitted from a non-learning remote control device, performs the infrared/electric conversion of the received remote control signal and sends out a demodulated signal; a control section 2 which has a micro-computer 2a for regulating the learning remote control device and acts so that the times during which the level of the demodulated signal sent out from the receiving section is nonzero and the times during which the level is zero are measured and the data of the measured times are processed as received data; a memory 3 such as a CMOS static random-access memory, which is connected to the control section and backed up by a power supply not shown in the drawings and stores the received data as those of the remote control signal; a plurality of control keys 4, each of which is manipulated to store the data of a received remote control signal or to select the stored data in the memory to transmit a reproduced remote control signal; a switch 5 for shifting the operation mode of the learning remote control device to receive and record the remote control signal from the non-learning remote control device or transmit the reproduced remote control signal; a display section 6 made of light emission diodes, liquid crystal display diodes or the like to show the sequence of the operation of the learning remote control device, a manipulating instruction or the like to the user of the learning remote control device; a transmitting section 7 which generates a modulated signal on the basis of the data selectively read from the memory through the manipulation of the control key, performs the electric/infrared conversion of the modulated signal to obtain the reproduced remote control signal, and transmits the produced remote control signal; and a sub-mode switch 8 for shifting the operation mode of the learning remote control devices to record the remote control signal through the comparison of the same transmitted remote control signals from the non-learning remote control device as discussed above in connection with a conventional learning remote control device, or to record the remote control signal without the comparison. Cyclic remote control signals can be recorded through the manipulation of the sub-mode switch 8, as described hereinafter.

When the remote control signal is transmitted from the non-learning remote control device through the manipulation thereof, the remote control signal is received and demodulated by the receiving section 1 so that the demodulated signal is sent out therefrom. When the demodulated signal is supplied to the control section 2, the time during which the level of the remote control signal is nonzero and the times during which the level is zero are measured from the demodulated signal so that the data of the measured times are decoded as received data.

The microcomputer 2a of the control section 2 performs processing under software control as described from now on. When the switch 5 is in a receiving position, the received data obtained as mentioned above are written in the reception buffer of the memory 3 to turn on the light emission diodes or the like of the display section 6 to urge the user of the learning remote control device to manipulate a desired one of the control keys 4. After the desired control key $4_1$, for example, is manipulated by the user, the received data in the reception buffer of the memory 3 are written in a storage region of the memory, which corresponds to the manipulated control key.

When the switch 5 is in a transmitting position, it is monitored whether or not the control keys 4 are manipulated. If the control key $4_1$ is manipulated, for example, the data previously written in the storage region of the memory 3, which corresponds to the manipulated control key, are read from the storage region and sent out to the transmitting section 7. The transmitting section 7 then generates the modulated signal on the basis of the data sent out from the control section 2, performs the electric/infrared conversion of the modulated signal to reproduce the remote control signal, and transmits the reproduced remote control signal. As a result, an appliance is operated by the reproduced remote control signal in the same manner as it is operated by the remote control signal directly transmitted from the non-learning remote control device.

Figure 2:
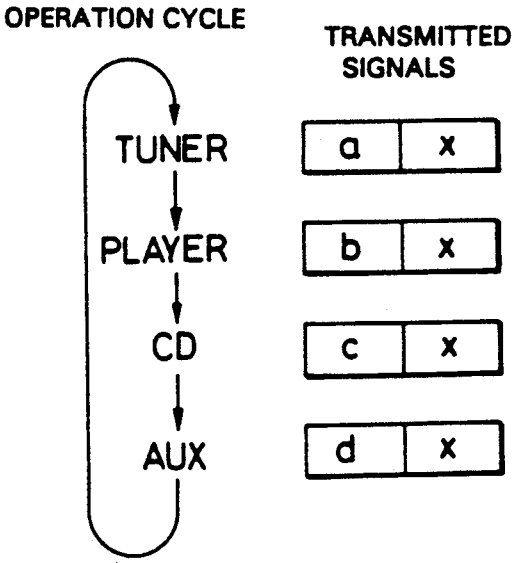
FIG. 2 shows a diagram of examples of cyclic remote control signals.
Figure 3:
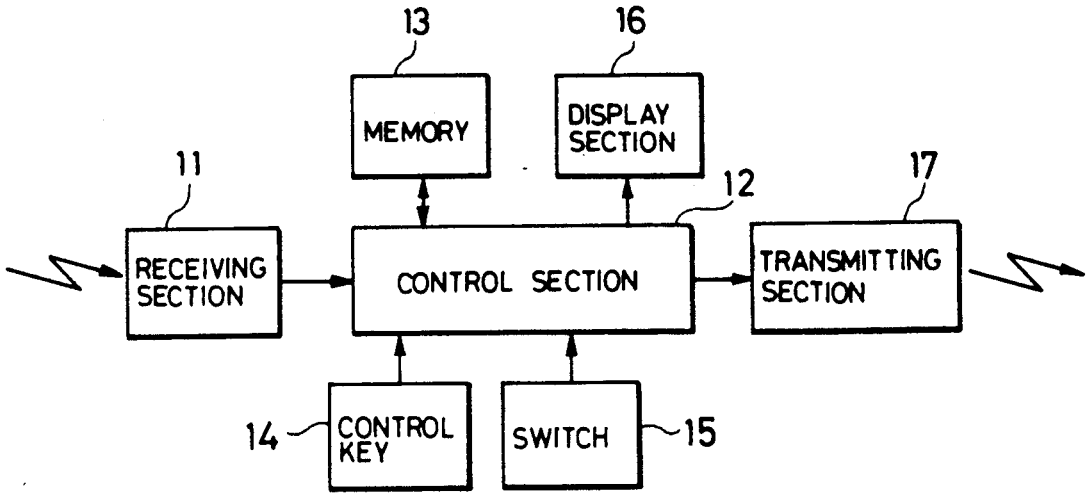
FIG. 3 PRIOR ART
FIG. 3 shows a block diagram of a conventional learning remote control device.
Figure 4A:
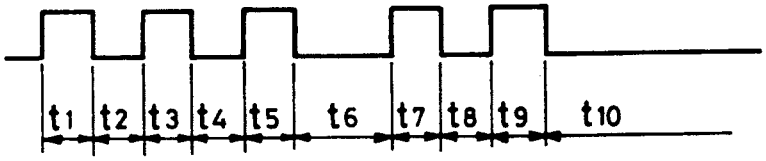
FIG. 4 shows a diagram of a remote control signal and a diagram of the stored data of the remote control signal.
Figure 4B:
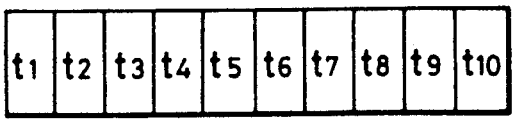

When the cyclic remote control signals a+x, b+x, c+x and d+x as shown in FIG. 2 are transmitted from a non-learning remote control device through the manipulation of a single key thereof, the cyclic remote control signal a+x, for example, is recorded in the storage region of the memory 3, which corresponds to the control key 41. Every time the control key 41 is thereafter manipulated as the switch 5 is in the transmitting position, the cyclic remote control signal a+x is transmitted from the learning remote control device. The prefix a of the transmitted cyclic remote control signal a+x does not play any role in cyclically shifting the operation mode of the appliance in a cycle of the use of a tuner, that of a player, that of a compact disk and that of an auxiliary unit in that order as shown in FIG. 2, but the code x of the cyclic remote control signal cyclically shifts the operation mode of the applicance. Although the prefixes of the cyclic remote control signals vary as a single key is sequentially manipulated in transmitting the cyclic remote control signals, the prefixes do not play any role in cyclically shifting the operation mode of the appliance in the cycle.

Each of such prefixes acts for the automatic gain control of a light receiving portion, for example, as well as for extension, so as to set the automatic gain control at optimum by the carrier level of the prefix to surely receive the following code x. Besides, a central processing unit provided in the remotely controlled appliance to receive and decode the remote control signal is put in an interruption mode by the prefix to perform interruption in response to the entry of the following code x to the appliance. If the prefix is only for the extension, the central processing unit neglects the prefix and decodes only the code x.

What is claimed is:

1. A learning control device of the type comprising a receiving means for receiving and demodulating a remote control signal from a remote control device; a memory means for storing data obtained by said receiving means through demodulation of the remote control signal; control keys each corresponding to a prescribed storage region of said memory means; a transmitting means for reproducing said remote control signal on the basis of said data read from said memory means and for transmitting said reproduced remote control signal; a first switch means for shifting the operation mode of said learning remote control device between a reception mode and a transmission mode; and a control means for writing said data from said receiving means into said storage region corresponding to one of said control keys when said operation mode is shifted to said reception mode by said first switch means, and for reading said data from said storage region corresponding to an operated on of said control keys to output the read data to said transmitting means when said operation mode is shifted to said transmission mode by said first switch means; the improvement comprising:

a sub-mode switch means for switching between a first position for writing data corresponding to a received non-cyclic remote control signal into said memory means and a second position for writing data corresponding to a received cyclic remote control signal into said memory means, said control means operable, when said sub-mode switch means is switched to the first position and said first switch means is shifted to the reception mode, for performing a comparison between data representing a first received non-cyclic remote control signal and data representing a second received non-cyclic remote control signal, the first and second received non-cyclic remote control signals being received by said receiving means after a same key of the remote control device is manipulated first and second times, respectively, said control means operable when said sub-mode switch means is shifted to a second position which is different from the first position and said first switch means is shifted to the reception mode, for not performing any comparison between data representing a first received cyclic remote control signal and data representing a second received cyclic remote control signal, the first and second cyclic remote control signal being received by said receiving means after a same key of the remote control device is manipulated first and second times. respectively.

2. The learning remote control device as claimed in claim 1, wherein said memory means is a CMOS static random-access memory.

3. The learning remote control device as claimed in claim 1, further comprising dispaly means, connected to said control means, for visually displaying a sequence of operation of the learning remote control device.

4. The learning remote control device as claimed in claim 1, wherein said memory means includes a reception buffer and wherein the data representing the first received non-cyclic remote control signal is stored in said reception buffer during the comparison.

5. The learning remote control device as claimed in claim 1, wherein the remote control device transmits an infrared remote control signal, said receiving means performs infrared-to-electric conversion of a received infrared remote control signal, and wherein said transmitting means performs electric-to-infrared conversion to produce the infrared remote control signal.

6. The learning remote control device as claimed in claim 1, wherein said control means includes a microcomputer.

* * * * *